US010471767B2

(12) United States Patent
Busam

(10) Patent No.: US 10,471,767 B2
(45) Date of Patent: Nov. 12, 2019

(54) FOLDER WITH MOVABLE DIVIDER

(71) Applicant: ACCO Brands Corporation, Lake Zurich, IL (US)

(72) Inventor: Edward P. Busam, Mason, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 15/674,933

(22) Filed: Aug. 11, 2017

(65) Prior Publication Data

US 2018/0043727 A1 Feb. 15, 2018

Related U.S. Application Data

(60) Provisional application No. 62/374,288, filed on Aug. 12, 2016, provisional application No. 62/374,291, filed on Aug. 12, 2016, provisional application No. 62/414,503, filed on Oct. 28, 2016.

(51) Int. Cl.

| | |
|---|---|
| ***B42F 11/00*** | (2006.01) |
| ***B42F 7/06*** | (2006.01) |
| ***B42F 21/04*** | (2006.01) |
| *B42F 17/12* | (2006.01) |

(52) U.S. Cl.

CPC ..... *B42F 11/00* (2013.01); *B42F 7/06* (2013.01); *B42F 21/04* (2013.01); *B42F 17/12* (2013.01)

(58) Field of Classification Search

CPC ..... B42F 11/00; B42F 19/04
USPC ..... 40/359; 229/67.1; 402/79
See application file for complete search history.

(56) References Cited

U.S. PATENT DOCUMENTS

| | | | | |
|---|---|---|---|---|
| 2,091,667 | A * | 8/1937 | Barnes | B42F 11/00 281/27.1 |
| 3,858,790 | A * | 1/1975 | Humphrey | B65D 27/08 150/147 |
| D267,152 | S | 12/1982 | Nerlinger, Jr. | |
| 4,795,287 | A * | 1/1989 | Friedman | B42F 5/00 383/84 |
| 4,991,767 | A | 2/1991 | Wyant | |
| 5,501,540 | A | 3/1996 | Ho | |
| 6,032,984 | A | 3/2000 | Ishida | |
| D432,166 | S * | 10/2000 | Matheson | D19/26 |
| 6,168,340 | B1 | 1/2001 | Lehmann et al. | |
| 6,666,610 | B1 | 12/2003 | Moor et al. | |
| 6,679,418 | B1 | 1/2004 | Schwartz | |
| 8,308,054 | B2 | 11/2012 | Jones et al. | |

(Continued)

OTHER PUBLICATIONS

Five Star 4-Pocket Paper Folder (33106C)—Mead; https://www.mead.com/mead/browse/product/4-Pocket+Paper+Folder/33106C; 7 pages (at least as early as Jul. 11, 2016).

*Primary Examiner* — Joanne Silbermann
(74) *Attorney, Agent, or Firm* — Fitch, Even, Tabin & Flannery LLP

(57) ABSTRACT

A folder including a main panel, a pocket panel coupled to the main panel and defining a pocket therebetween, and a divider coupled to the main panel. The divider is movable between an inserted position wherein at least part of the divider is positioned in the pocket, and a retracted position wherein the at least part of the divider is not positioned in the pocket. The divider includes at least one of a slit or a notch to provide ease of movement of the divider in moving between the inserted position and the retracted position.

23 Claims, 8 Drawing Sheets

(56) References Cited

U.S. PATENT DOCUMENTS

| | | | | |
|---|---|---|---|---|
| 2005/0156017 | A1* | 7/2005 | Crum | B42F 7/06<br>229/67.1 |
| 2008/0179875 | A1 | 7/2008 | Witter | |
| 2014/0339805 | A1* | 11/2014 | James, Jr. | B65D 27/08<br>281/27.2 |

* cited by examiner

FOLDER WITH MOVABLE DIVIDER

This application claims priority to U.S. Provisional Patent Application Ser. No. 62/374,288 filed on Aug. 12, 2016 and entitled Folder with Movable Divider; and U.S. Provisional Patent Application Ser. No. 62/374,291 filed on Aug. 12, 2016 and entitled Dual Binding System; and U.S. Provisional Patent Application Ser. No. 62/414,503 filed on Oct. 28, 2016 and entitled Folder with Movable Divider. The entire contents of all three U.S. provisional applications are hereby incorporated by reference.

The present invention is directed to a folder, and more particularly, to a folder including a movable divider.

BACKGROUND

School and office products, such as folders, filers, portfolios, pockets, storage devices and the like (collectively termed a "folder" herein) are often utilized to provide pockets to store papers and other loose items. In some cases, the folder may include a divider to sub-divide the pocket into pocket compartments. However the dividers in many existing folders are not sufficiently flexible/movable, may be relatively stiff and/or prone to tearing during use.

SUMMARY

In one embodiment the present invention is a folder including a main panel, a pocket panel coupled to the main panel and defining a pocket therebetween, and a divider coupled to the main panel. The divider is movable between an inserted position wherein at least part of the divider is positioned in the pocket, and a retracted position wherein the at least part of the divider is not positioned in the pocket. The divider includes at least one of a slit or a notch to provide ease of movement of the divider in moving between the inserted position and the retracted position.

DETAILED DESCRIPTION

Figure 1:
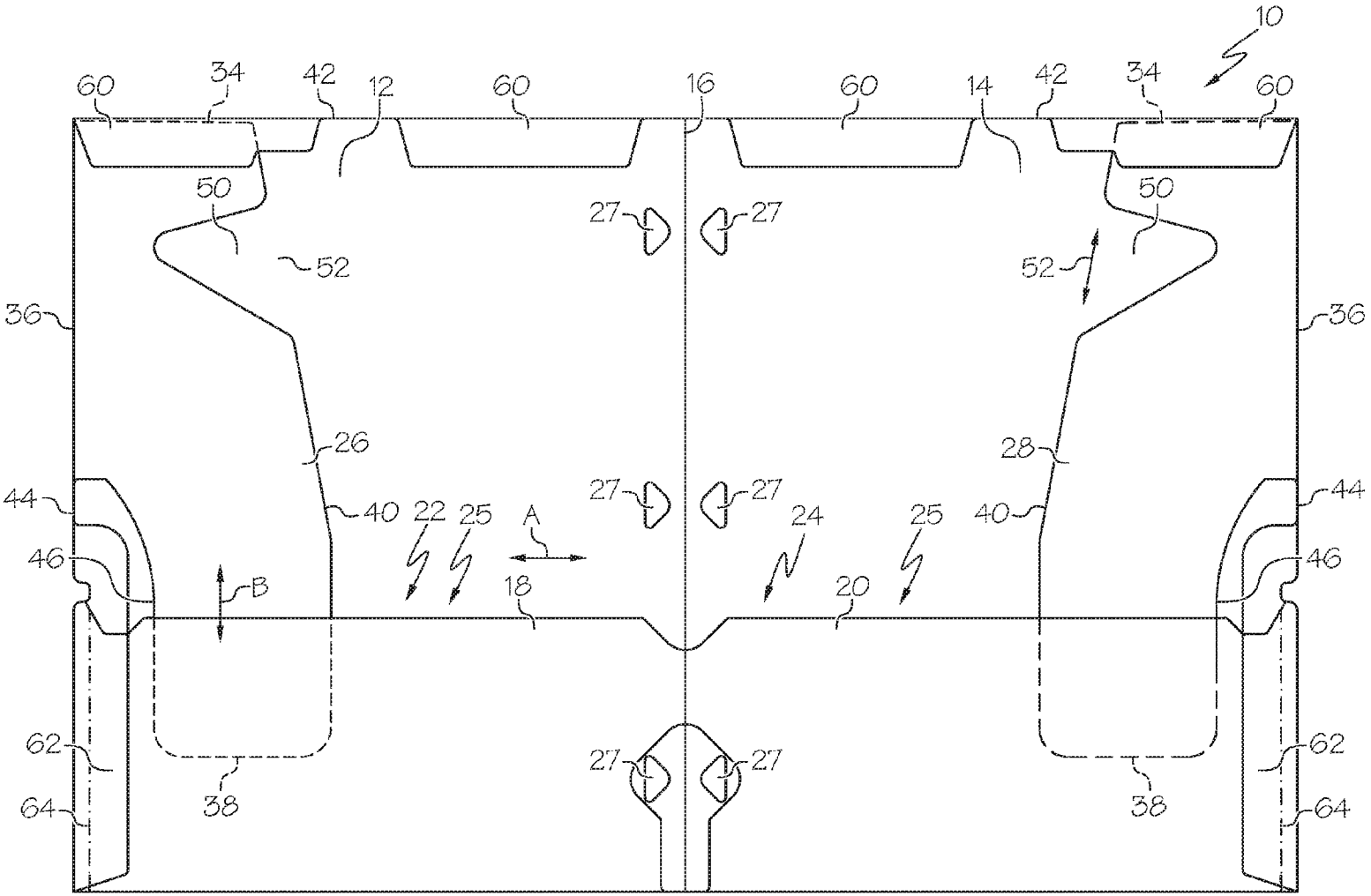
FIG. 1 is a top view of one embodiment of a folder, shown in its open position.
Figure 2:
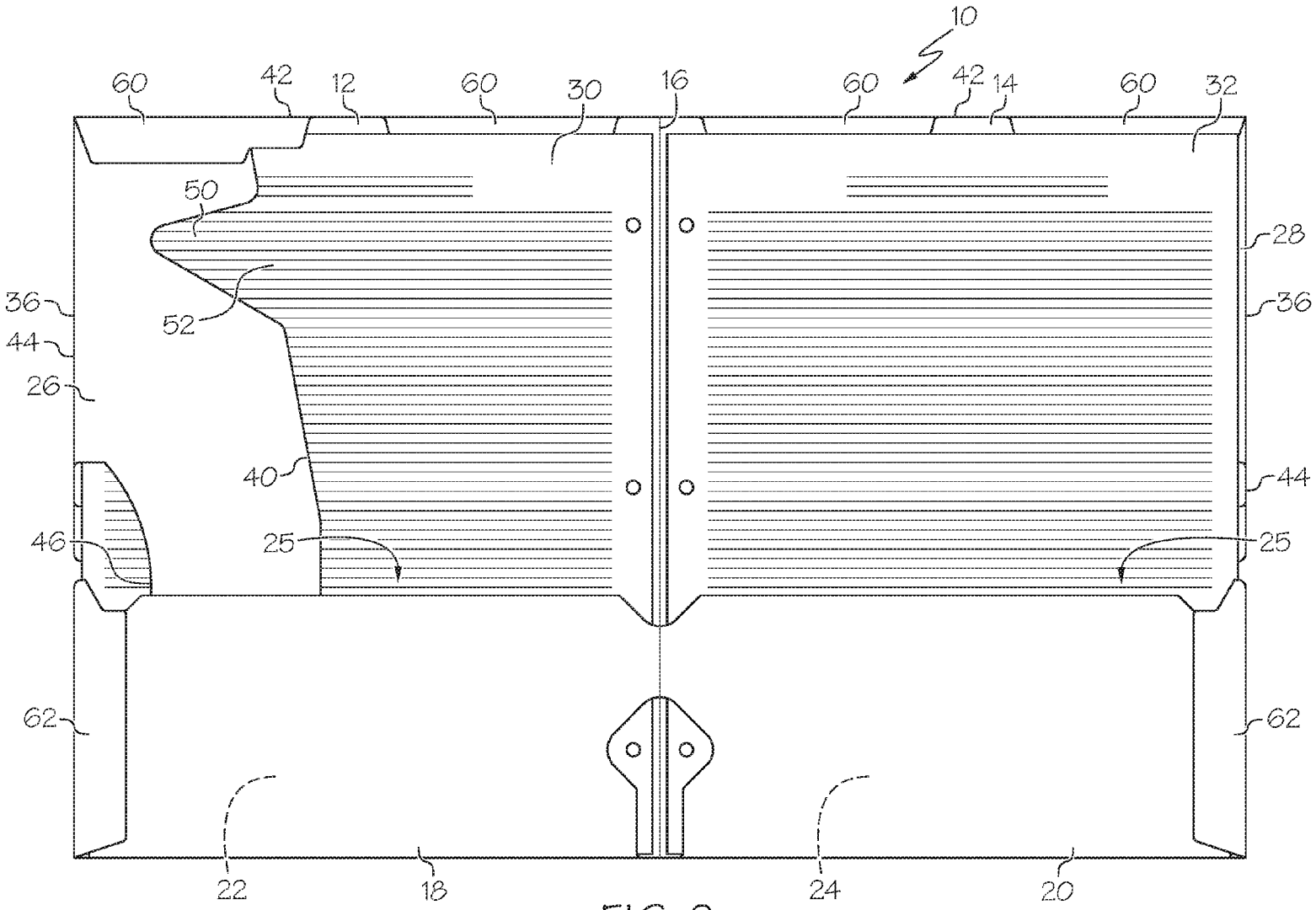
FIG. 2 is a top view of the folder of FIG. 1, with a piece of paper inserted in one pocket of the folder below the associated divider, and another piece of paper inserted in the other pocket of the folder above the associated divider.
Figure 3:
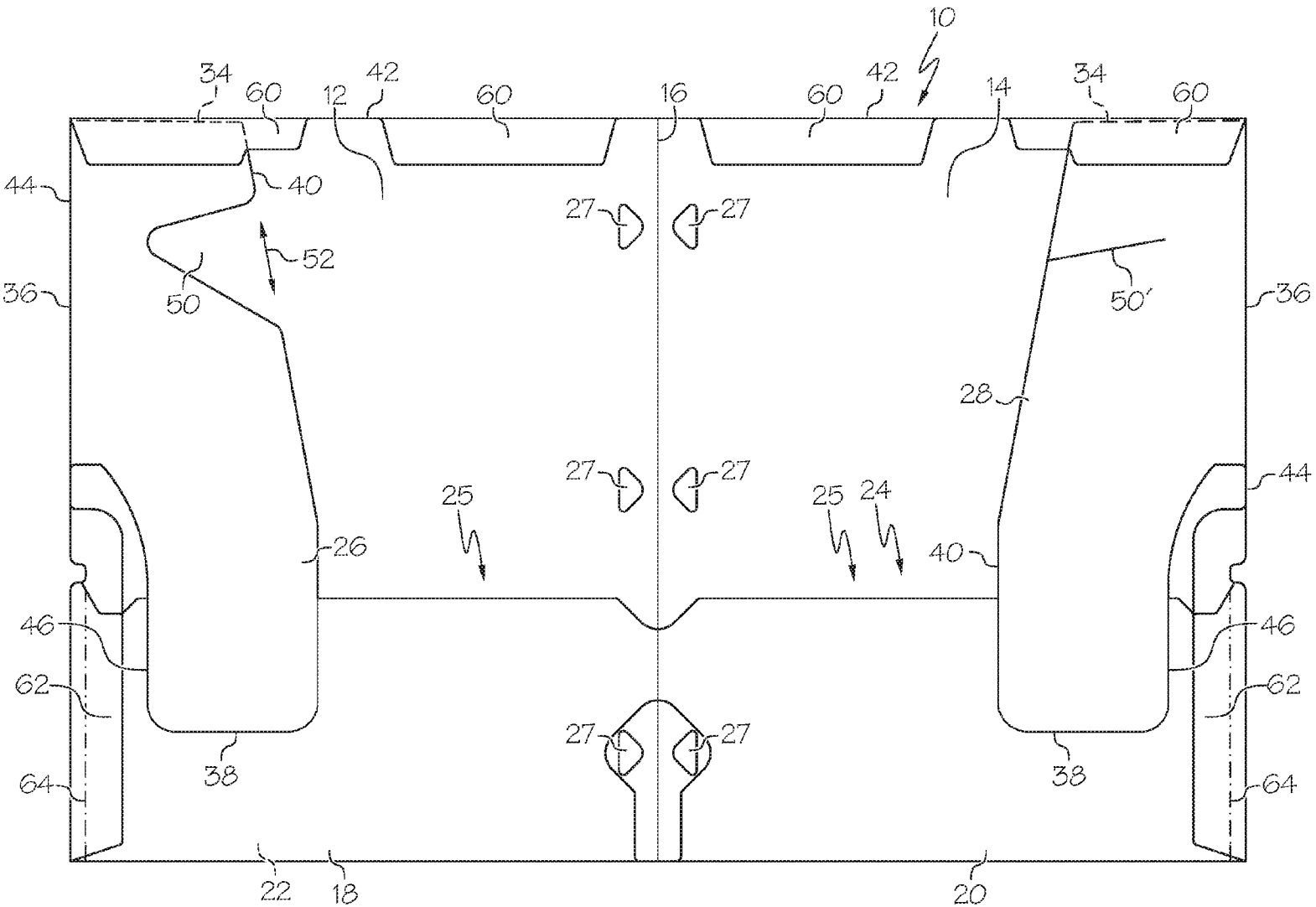
FIG. 3 is a top view of the folder of FIG. 1, with the dividers positioned outside of the associated pockets, and with one of the dividers including a slit instead of a cut-out.

In one embodiment, with reference to FIGS. 1-3, the folder 10 can include a first main panel 12 and a second main panel 14 pivotally coupled together along a central pivot line or fold line 16. FIGS. 1-3 illustrate the folder 10 in its open position wherein the main panels 12, 14 are positioned adjacent to each in a side-by-side configuration. The folder

Figure 4:
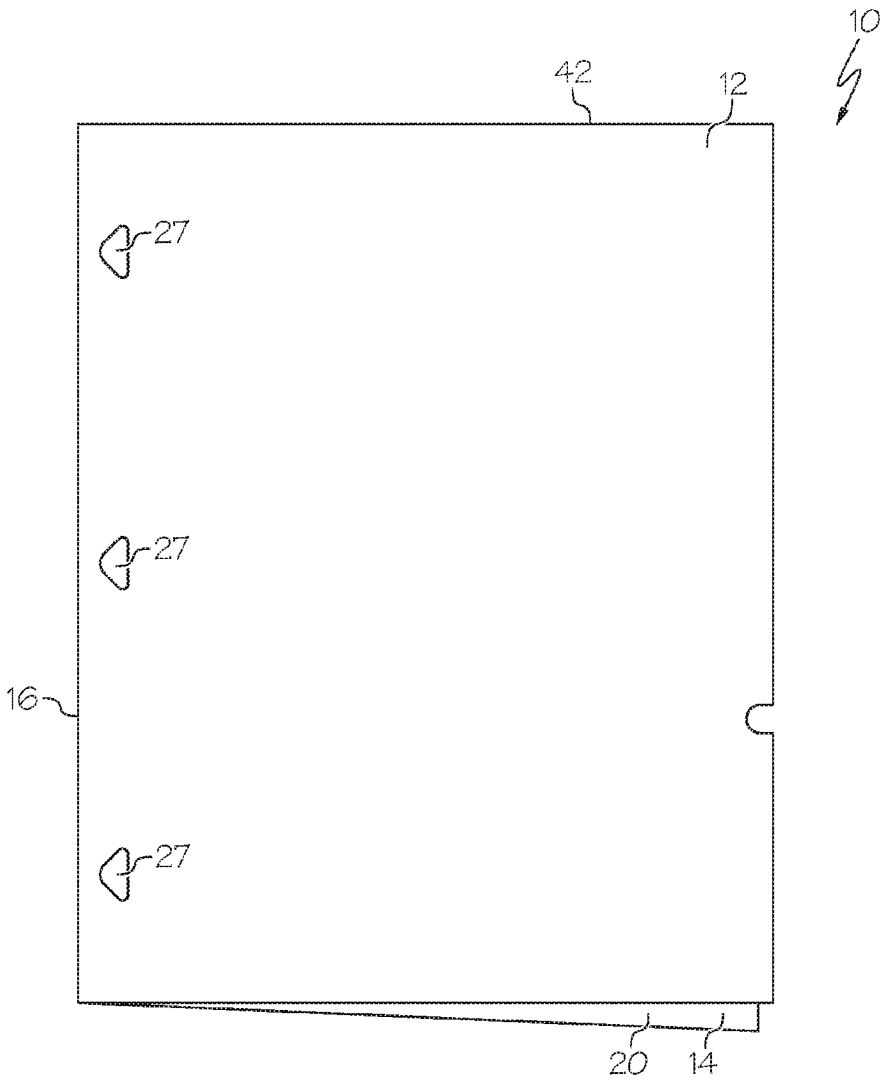
FIG. 4 is a top view of the folder of FIG. 1, shown in its closed position.

10 and/or panels 12, 14 can be foldable or pivotable about the fold line 16 to its closed position, shown in FIG. 4, where the main panels 12, 14 are generally aligned. The panels 12, 14 can each have a series of holes 27 extending therethrough and positioned adjacent to the fold line 16 to enable the folder 10 to be coupled to binding mechanism, such as a three ring binder (not shown).

In the illustrated embodiment each main panel 12, 14 is generally flat and planar, and generally rectangular in top view. The first and second main panels 12, 14 may each include or be coupled to an associated pocket panel 18, 20, which are also each generally rectangular in top view in the illustrated embodiment. Each pocket panel 18, 20 is positioned on or adjacent to an inner surface of the associated main panel 12, 14 to define a pocket 22, 24 therebetween such that papers and other loose items can be positioned in each pocket 22, 24. Each pocket 22, 24 can have a mouth 25 providing access thereto and extending laterally along an upper edge of each pocket 22. It should be understood that the shape and configuration of the folder 10, including the first 12 and second 14 main panels, pocket panels 18, 20 and pockets 22, 24 can be varied as desired beyond that shown and described herein.

The folder 10 can include a pair of dividers or divider flaps 26, 28, where each divider 26, 28 may be coupled to an associated main panel 12, 14. Each divider 26, 28 can be movable between an inserted position wherein at least part (a lower/distal part, in the illustrated embodiment) of each divider 26, 28 is positioned in the associated pocket 22, 24 below the mouth 25 (FIGS. 1 and 2), and a retracted position wherein the at least part of each divider 26, 28 and/or the entirety of each divider 26, 28 is not positioned in the associated pocket 22, 24 and is generally parallel with a plane of the associated main panel 12, 14 (FIG. 3).

When each divider 26, 28 is in its inserted position, the divider 26, 28 can divide each pocket 22, 24 into smaller pockets or sub-compartments to aid in organization of the contents of the pockets 22, 24. For example, FIG. 2 illustrates a paper 30 positioned in the pocket 22 behind the divider 26 (e.g. positioned between the divider 26 and the main panel 12), and another paper 32 positioned in the pocket 24 in front of the divider 28 (e.g. positioned between the divider 28 and the pocket panel 20). Thus various papers or other items positioned in each pocket 22, 24 can be located in front of, behind, or both in front of and behind the associated divider 26, 28.

Each divider 26, 28 can be generally rectangular in top view, having an upper edge 34, an outer edge (or a first side edge) 36, a lower edge 38 and an inner edge 40 (or a second side edge 40 positioned opposite the first side edge 36). In one case, the upper edge 34 of each divider 26, 28 is coupled to, or positioned adjacent to or aligned with upper edge 42 of the associated main panel 12, 14 along an entire length of the upper edge 34. In addition, the outer edge 36 of each divider 26, 28 can be coupled to an outer edge 44 of the associated main panel 12, 14 for at least a portion thereof, where each outer edge 36, 44 is generally perpendicular to the upper edge 34, 42. In the illustrated embodiment a distal/lower portion 46 of the outer edge 36 of each divider 26, 28 moves inwardly away from the outer edge 44 of the associated main panel 12, 14 when moving in a downward direction, away from the upper edge 34, to enable each lower portion 46 to fit into the associated pocket 22, 24. In the illustrated embodiment the lower edge 38, inner edge 40, and lower portion 46 of the outer edge 36, of each divider 26, 28, is a free edge not directly coupled the associated main panel 12, 14.

The mouth 25 of each pocket 22, 24 can extend along a first (lateral) direction A (FIG. 1), perpendicular to the fold line 16. The folder 10, main panels 12, 14, pocket panels 18, 20, pockets 22, 24 and dividers 26, 28, can each have a height extending in a second direction B (FIG. 1) perpendicular to the first direction A. Each divider 26, 28, may in one case have a maximum width extending along the first direction A that is at least about 1/10, or at least about 1/8, but less than about 1/2 in one case, of the width of the associated pocket 22, 24 and/or associated main panel 12, 14 such that each divider 26, 28 has sufficient width to effectively operate as a divider but is not so wide as to make insertion into or retraction from the pocket 22, 24 difficult. However, the divider 26, 28 can have other widths if desired.

Each divider 26, 28 can have a height greater than a height of the associated pocket panel 18, 20 and/or pocket 22, 24, but less than a height of the associated main panel 12, 14. In one case each divider 26, 28 can have a height that is greater than a height of the associated main panel 12, 14, minus (or less) a height of the associated pocket panel 18, 20. Providing a divider 26, 28 with these height dimensions can help to ensure that each divider 26, 28 has sufficient height to extend downwardly into an associated pocket 22, 24. In another case, each divider 26, 28 can have a height greater than a distance between the upper edge 42 of the associated main panel 12, 14 and the upper edge of the pocket panel 18 (or the mouth 25). Providing a divider 26, 28 with this height dimension can help to ensure that each divider 26, 28 is sufficiently long to extend from an upper edge 42 of the associated main panel 12, 14, into the associated pocket 22, 24.

As noted above, when in their inserted positions the dividers 26, 28 can help to segregated and organize contents of the pockets 22, 24. In some cases, such as when additional storage capacity is desired or to avoid interference with the contents of a pocket 22, 24, it may be desired to move each divider 26, 28 to its retracted position outside the pocket 22, 24, as shown in FIG. 3. Each divider 26, 28 can include a notch 50 formed therein to provide ease of movement of the divider 26, 28 between the inserted position and the retracted position. In the illustrated embodiment each notch 50 is positioned in/formed in the inner/second side edge 40 of the divider 26, 28. In this case the inner edge 40 can be generally straight/linear/continuous on either side of the notch 50, except for those portions where the notch 50 is located. The notch 50 can be generally "V" or generally "U" shaped with a mouth 52 extending along or facing the inner edge 40 of the divider 26, 28. The notch 50 is or can be viewed as a "negative space" with material removed from or not present in the divider 26, 28 where it would otherwise be expected to be, based upon the otherwise relatively continuous outer perimeter/edge 40. Alternatively, the notch 50 can be replaced with or take the form of a slit or cut 50' (FIG. 3) formed in the divider 26, 28, either parallel with the upper edge 42, or angled, curved, etc., with no material "removed" in one case, where the slit or cut 50' can have the same qualities of the notch 50 as described herein to the extent possible.

As noted above, each notch 50 or slit 50' can lend flexibility to the associated divider 26, 28 and provide ease of movement of the divider 26, 28 between the inserted and retracted positions without tearing. The notch 50 or slit 50' can thus be positioned at the areas where the highest stresses would be located in the divider 26, 28 when the divider 26, 28 is moved between its inserted and retracted positions if the notch 50 were not present. In the illustrated embodiment the entire notch 50 or slit 50' is positioned at a height position (i.e. in a vertical direction of FIGS. 1-3 along direction B) along the inner edge 40 of the divider 26, 28 such that the notch 50 or slit 50' is entirely positioned in an upper half or upper third of a height of the divider 26, 28, distant from the mouth 25 of the associated pocket 22, 24. The entire notch 50 or slit 50' can be located adjacent to the upper edge 42; e.g. in one case positioned at a height position within an upper third or upper half of the associated panel 12, 14.

The notch 50 or slit 50' can also have sufficient depth or width (in a dimension along direction A, or in a direction generally perpendicular to the inner edge 40) to provide sufficient stress relief without unduly comprising the strength of the divider 26, 28. In one case the notch 50 or slit 50' extends at least about 15% in one case, or at least about 25% in one case, or at least about 50% in another case, of a width of the divider 26, 28 (at a height where the notch 50 or slit 50' is located), but less than about 80% of the width of the divider 26, 28 so that the divider 26, 28 has sufficient flexibility but is not too weakened by the notch 50 or slit 50'. The mouth 52 of the notch 50 may also extend sufficiently along the height of the divider 26, 28 (along direction A) to accommodate expected stresses. In one case the mouth 52 of each notch 50 has a height that is at least about 1/10 in one case, or at least about 1/8 in another case, of a height the divider 26, 28, but less than 1/3 of the height of the divider 26, 28 in one case, so that the divider 26, 28 has sufficient flexibility but is not too weakened by the notch 50.

Figure 7:
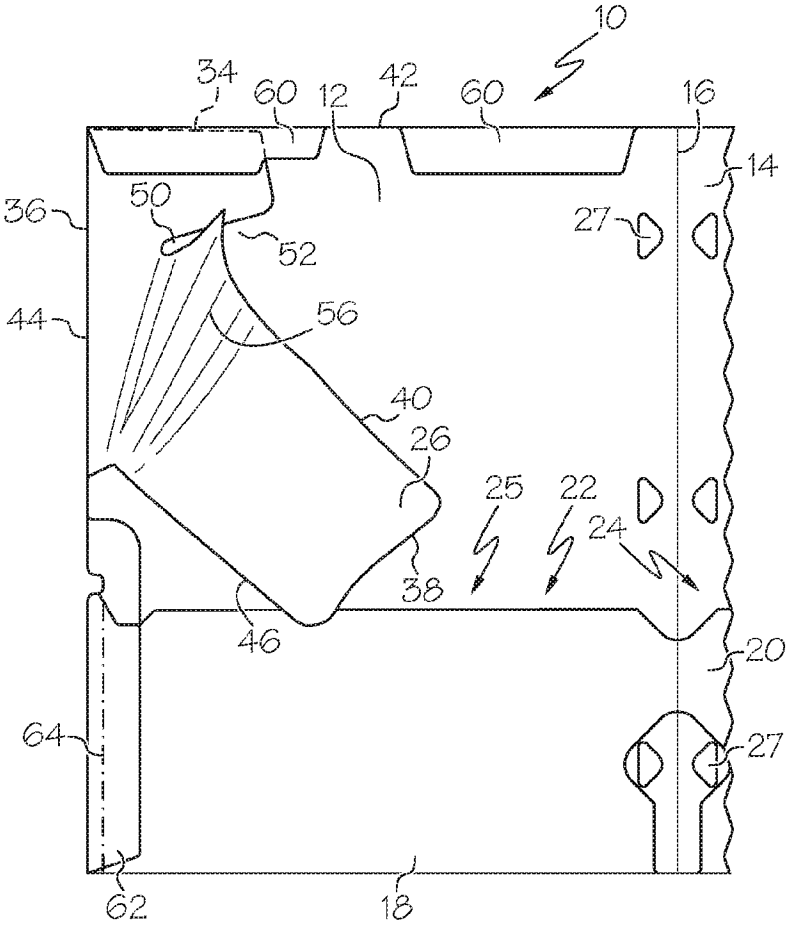
FIGS. 6-8 are a series of top views of a portion of the folder of FIG. 1, showing the divider moved from inside the pocket to outside the pocket.
Figure 6:
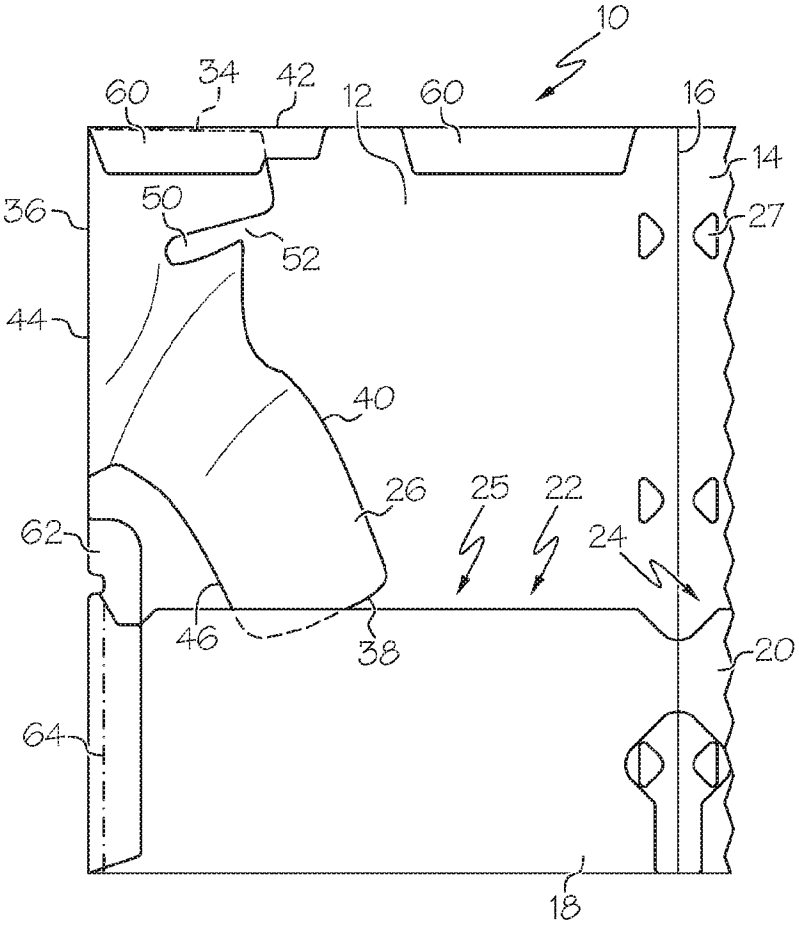
Figure 9:
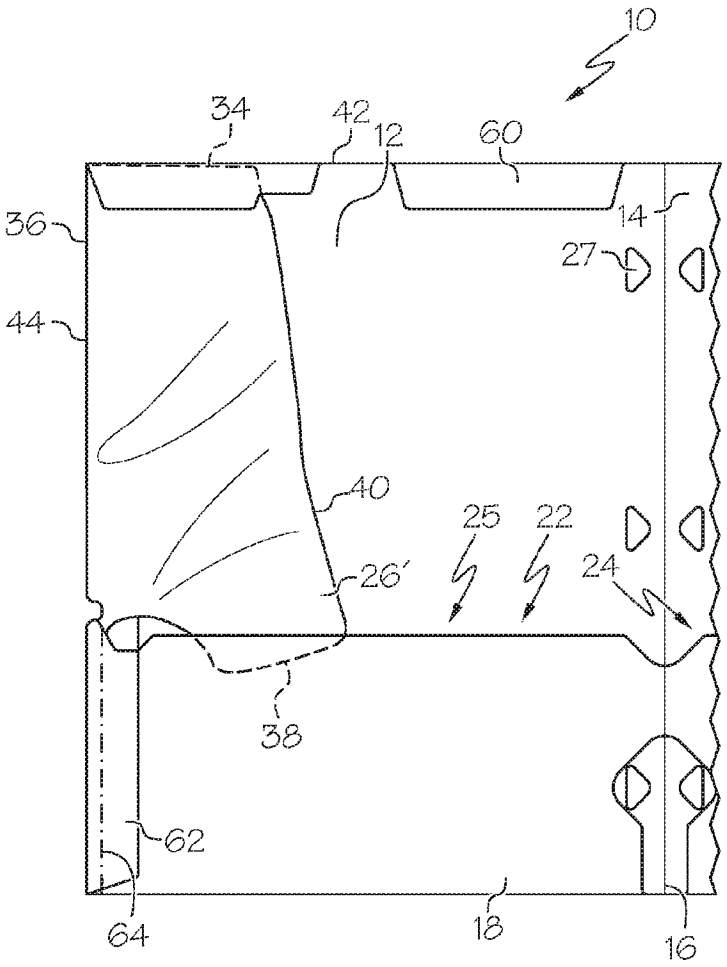
FIGS. 9 and 10 are a series of top views of a portion of another folder, showing movement of a divider.
Figure 8:
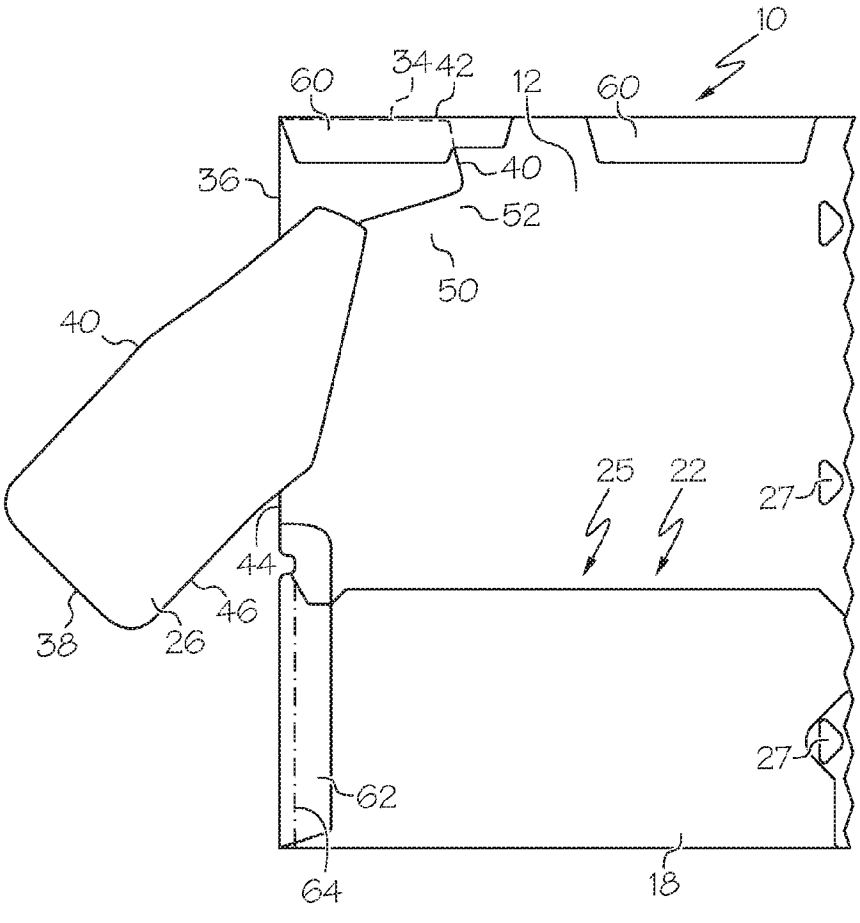
Figure 10:
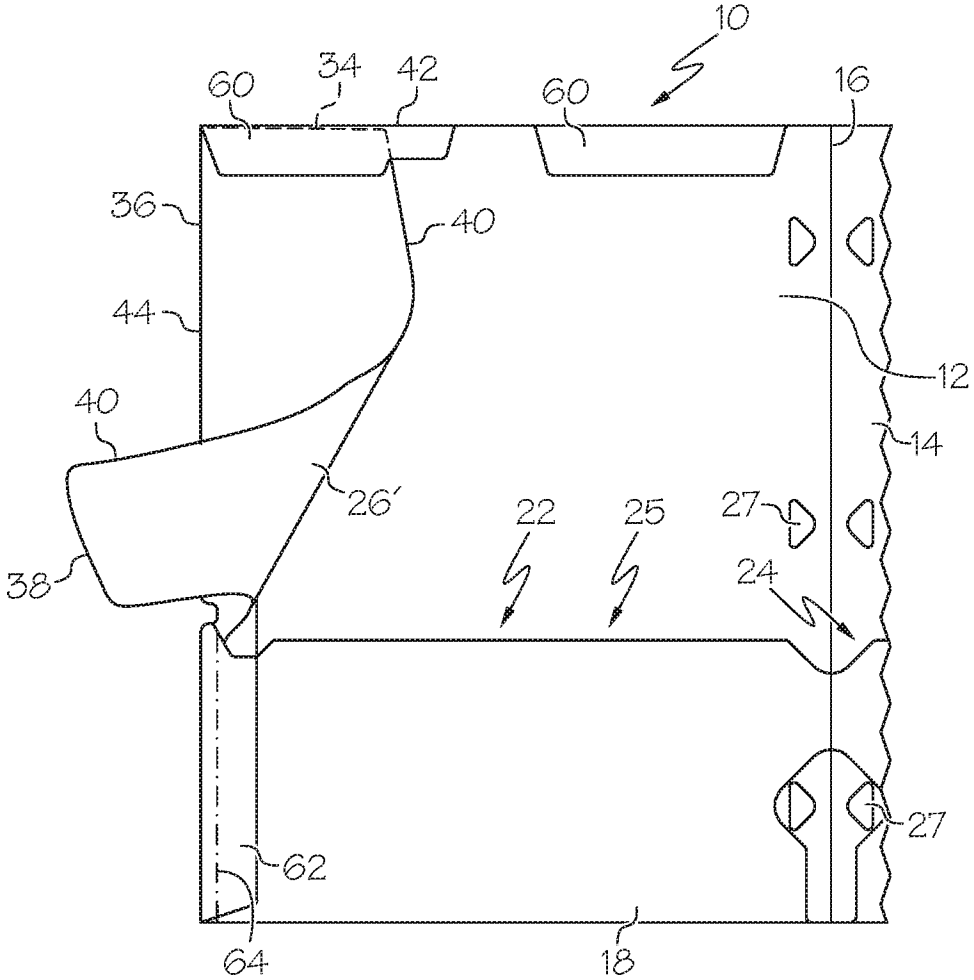

FIGS. 6-8 illustrate in one case how the divider 26 and notch 50 can flex and deform as the divider 26 is moved from its inserted position to its retracted position (with the understanding that the other divider 28 can move in generally the same manner with the same qualities). The divider 26 can have significant flexibility and/or deformation in the areas adjacent/below the notch 50 (such as area 56 shown in FIG. 7), to allow the portion 56 to flex out of a plane of the divider 26/folder 10. As shown in FIG. 8 the notch 50 provides significant flexibility to enable the free/distal portions of the divider 26 to be moved significantly outside the footprint or outer perimeter of the main panels 12/14 and/or folder 10 to provide improved access to the pocket 22; in the illustrated case more than 50% of the surface area of the divider 26 is movable outside the footprint of the main panels 12/14 and/or folder 10 without causing any tearing or permanent deformation of the divider 26 or folder 10. In contrast, FIGS. 9 and 10 illustrate a divider 26' lacking the notch 50, and the divider 26' is coupled to the main panel 12 along all or substantially all of its outer edge 36, which together result in a divider 26' with more restricted flexibility and range of motion.

Figure 5:
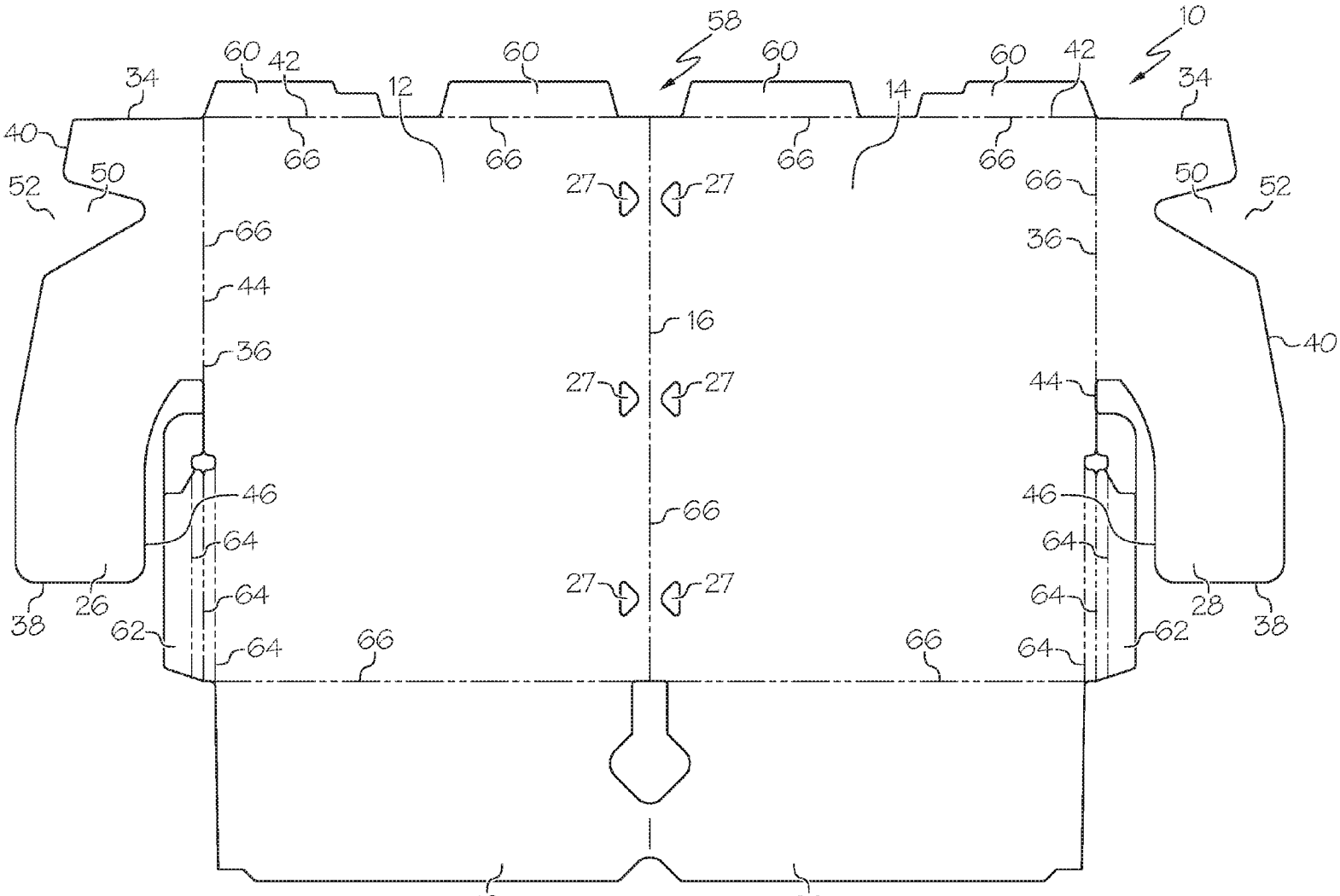
FIG. 5 is a top view of a blank that can be used to form the folder of FIG. 1.

The folder 10 can be made from a blank 58 such as that shown in FIG. 5. The blank 58 may be made of a relatively thin sheet-like material that is generally rectangular in shape, and includes the main panels 12, 14, pocket panels 18, 20 and dividers 26, 28, all laid flat and co-planar. The blank 58 can also include various upper coupling flaps 60 and side coupling flaps 62 spaced about the perimeter of the main panels 12, 14. The side coupling flaps 62 can include score or fold lines 64 formed therein to provide expansion capabilities to the pockets 22, 24. Various additional fold lines 66 are positioned in the blank.

In one embodiment the blank 58 (including the main panels 12, 14, pocket panels 18, 20 dividers 26, 28, and coupling flaps 60, 62) are formed of a single unitary seamless piece of material. Alternatively, however, if desired the blank 58 can be made of different pieces of material joined together. The blank 58 (and folder 10) can be made of any wide variety of materials including but not limited to polymers (including plastic), cardboard, paper, polymer-coated paper or cardboard, fabric coated paper or cardboard, etc.

In order to form the folder 10 from the blank 58, the dividers 26, 28 are folded inwardly about the associated fold line 66 until the dividers 26, 28 are positioned flat against the main panels 12, 14. Next the pocket panels 18, 20 are folded inwardly about the associated fold lines 66 until the pocket panels 18, 20 are positioned flat against the main panels 12, 14. Finally, the coupling flaps 60, 62 are folded inwardly about the associated fold lines 66, 64 and secured to the main panels 12, 14, pocket panels 18, 20, and dividers 26, 28 such as by a suitable adhesive, or other suitable joining means or methods, such as welding. If desired, the dividers 26, 28 can be folded inwardly after the pocket panels 18, 20, and coupling flaps 60, 62 are folded inwardly, or other changes in the order of assembly can be instituted. In any case after assembly the folder 10 can be then used in the manner described and shown herein, providing the associated features and benefits.

Having described the invention in detail and by reference to the various embodiments, it should be understood that modifications and variations thereof are possible without departing from the scope of the claims of the present application.

What is claimed is:

1. A folder comprising:

a main panel;

a pocket panel coupled to said main panel and defining a pocket therebetween; and a divider coupled to said main panel, said divider being movable between an inserted position wherein at least part of said divider is positioned in said pocket, and a retracted position wherein said at least part of said divider is not positioned in said pocket, wherein said divider includes at least one of a slit or a notch to provide ease of movement of said divider in moving between said inserted position and said retracted position, wherein said divider is permanently coupled to said main panel along at least part of a first side edge of said divider, and wherein said divider includes an upper edge oriented generally perpendicular to said first side edge, and wherein said divider is permanently coupled to said main panel along said upper edge.

2. The folder of claim 1 wherein said divider includes a second side edge positioned on an opposite side of said divider relative to said first side edge, and wherein said at least one of a slit or a notch is formed in said second side edge.

3. The folder of claim 2 wherein said divider is not coupled to said main panel along said second side edge.

4. The folder of claim 2 wherein said at least one of a slit or a notch includes said notch and wherein said second side edge is generally straight on either side of said notch except for where said notch is located.

5. The folder of claim 2 wherein part of said first side edge of said divider is coupled to said main panel and another part of said first side edge of said divider is not coupled to said main panel.

6. The folder of claim 1 wherein said first side edge of said divider is aligned with a side edge of said main panel, and wherein said upper edge of said divider is aligned with an upper edge of said main panel.

7. The folder of claim 1 wherein said divider has a width extending generally perpendicular to said first side edge, and wherein said slit or notch extends at least about 50% of said width.

8. The folder of claim 1 wherein said divider includes a notch that is generally "V" shaped or generally "U" shaped in top view.

9. The folder of claim 8 wherein said pocket has a mouth extending in a first direction and said divider has a height extending in a second direction perpendicular to said first direction, and wherein said notch has a mouth with a height that is at least about 1/10 of a height of said divider.

10. The folder of claim 1 wherein said pocket has a mouth extending in a first direction and said pocket panel has a height extending in a second direction perpendicular to said first direction, and wherein said divider has a height that is greater than the height of said pocket panel.

11. The folder of claim 1 wherein said at least part of said divider is a lower portion of said divider, and wherein only said at least part of said divider is positionable in said pocket when said divider is in said inserted position.

12. The folder of claim 1 further comprising:

a supplemental main panel coupled to said main panel along a hinge line;

a supplemental pocket panel coupled to said supplemental main panel and defining a supplemental pocket therebetween; and a supplemental divider coupled to said supplemental main panel, said supplemental divider being movable between an inserted position wherein at least part of said supplemental divider is positioned in said supplemental pocket, and a retracted position wherein said at least part of said supplemental divider is not positioned in said supplemental pocket, wherein said supplemental divider includes at least one of a slit or a notch to provide ease of movement of said supplemental divider in moving between said inserted position and said retracted position.

13. The folder of claim 1 wherein said divider is directly coupled to said main panel along at least part of a first side edge of said divider and wherein said divider is directly coupled to said main panel along said upper edge of said divider.

14. The folder of claim 1 wherein said divider is non-pivotally coupled to said main panel and wherein said pocket panel is non-pivotally coupled to said main panel.

15. A folder comprising:

a main panel;

a pocket panel coupled to said main panel and defining a pocket therebetween; and a divider having an upper edge, a lower edge, an inner edge and an outer edge, wherein said divider is non-pivotally coupled to said main panel along at least part of said upper edge and at least part of said outer edge, wherein said divider is movable between an inserted position wherein at least part of said divider is positioned in said pocket and a retracted position wherein no part of said divider is positioned in said pocket, wherein said divider includes at least one of a slit or a notch at said inner edge to provide ease of movement of said divider in moving between said inserted position and said retracted position.

16. The folder of claim 15 wherein said divider is coupled to said main panel along only part of said outer edge, and wherein said inner edge is positioned on an opposite side of said divider relative to said outer edge.

17. The folder of claim 15 wherein said divider is generally rectangular in top view and includes a notch which is generally "U" shaped or generally "V" shaped in top view.

18. A folder comprising:

a main panel;

a pocket panel coupled to said main panel and defining a pocket therebetween; and a divider coupled to said main panel, said divider being movable between an inserted position wherein at least part of said divider is positioned in said pocket, and a retracted position wherein said at least part of said divider is not positioned in said pocket, wherein said divider includes at least one of a slit or a notch formed in an inner edge thereof to provide ease of movement of said divider in moving between said inserted position and said retracted position, wherein said divider has a width extending generally perpendicular to said inner edge, and wherein said slit or notch extends at least about 15% of said width, wherein said divider has an outer edge directly coupled to said main panel, and wherein said inner edge is positioned on an opposite side of said divider from said outer edge.

19. The folder of claim 18 wherein said slit or notch extends at least about 15% of said width of said divider at a location of said divider where said slit or notch is located.

20. The folder of claim 18 wherein said slit or notch extends at least about 25% of said width.

21. A folder comprising:

a main panel including a main panel edge;

a pocket panel coupled to said main panel and defining a pocket therebetween; and a divider including a first side edge and a second side edge positioned on an opposite side of said divider relative to said first side edge, wherein said divider is coupled to said main panel edge along said first side edge and is movable between an inserted position wherein at least part of said divider is positioned in said pocket and a retracted position wherein said at least part of said divider is not positioned in said pocket, wherein said divider includes at least one of a slit or a notch positioned on said second side edge, and wherein a lower portion of said first side edge is not directly coupled to the main panel.

22. The folder of claim 21 wherein the lower portion of the first side edge is generally parallel to the main panel edge.

23. The folder of claim 21 wherein the lower portion of the first side edge of the divider is spaced laterally inwardly from the main panel edge.

* * * * *